US006178090B1

(12) United States Patent
Cheng

(10) Patent No.: US 6,178,090 B1
(45) Date of Patent: Jan. 23, 2001

(54) LOTION BOTTLE FIXING BASE

(76) Inventor: Wen Ping Cheng, Rm. 4DO9, No. 5, Sec. 5, Hsin Yih Rd., Taipei (TW)

( * ) Notice: Under 35 U.S.C. 154(b), the term of this patent shall be extended for 0 days.

(21) Appl. No.: 09/517,307

(22) Filed: Mar. 2, 2000

(51) Int. Cl.[7] ..... H05K 5/00

(52) U.S. Cl. ..... 361/752; 361/753; 215/11.1; 215/11.2; 215/11 R; 215/11 C

(58) Field of Search ..... 361/752, 753; 206/101, 107, 109, 771, 5.01; 215/11.1–11.3

(56) References Cited

U.S. PATENT DOCUMENTS 3,627,161 * 12/1971 Wergeland ..... 215/11 C
4,869,381 * 9/1989 Agner ..... 215/11.1
4,898,060 * 2/1990 To ..... 84/95.2
4,979,629 * 12/1990 Askerneese ..... 215/11.1
5,033,631 * 7/1991 Nightngale ..... 215/11.1
5,489,893 * 2/1996 Jo et al. ..... 340/686
6,024,625 * 2/2000 Pearce ..... 446/81
6,104,292 * 8/2000 Rombom et al. ..... 340/573.1

* cited by examiner

*Primary Examiner*—Jeffrey Gaffin
*Assistant Examiner*—Tuan Dinh
(74) *Attorney, Agent, or Firm*—Bacon & Thomas, PLLC

(57) ABSTRACT

A lotion bottle fixing base unit, comprising a base, a fixing unit, an IC circuit set and a silicone rubber washer. The base and fixing unit are extrusion formed plastics. The IC circuit set is installed in the round groove on the base. The silicone rubber washer is installed at an appropriate location on the base. The covering groove at the lower part of the fixing unit serves to cover the entire base. The bottle fixing groove on the upper part of the fixing unit serves to accommodate a lotion bottle or similar bottle or container. A daily-use bottle can be fixed by the user to the base, so that when the user presses on the lotion bottle on the fixing unit, the fixing unit will activate the flexible switch, and the base will produce music to entertain the user.

4 Claims, 3 Drawing Sheets

LOTION BOTTLE FIXING BASE

FIELD OF THE INVENTION

The invention relates to a lotion bottle fixing base, used to fix a lotion bottle or similar bottle or container. It is so designed that, when the user presses on the lotion bottle, the bottle will not overturn due to the small area of the bottom of the bottle, and the base will produce melodious music to enhance the attractiveness of the product itself, and stimulate the consumer's purchasing desire.

BACKGROUND OF THE INVENTION

Bottles are widely used in household appliances to contain lotion, hair cream, skin care and hand washing cream, etc. To stimulate consumer's purchasing desire, manufacturers would place much emphasis on packaging designs. Bottles are mostly made of glass material, so they may easily be broken by the consumer in daily handling.

BRIEF DESCRIPTION OF THE INVENTION

The main objective of the invention is to provide a fixing base that gives out music and can secure a bottle. So the daily-use bottle can be properly protected from overturning or breaking by negligence. When the user presses the lotion bottle, the IC circuit set of the invention will produce melodious music to enhance more attractiveness to the product itself, and stimulate the consumer's purchasing desire.

The invention relates to a special base and fixing base that are made of extrusion formed plastics, the user can insert a lotion bottle or any daily-use bottle in the fixing base; a circular washer made of silicone rubber is installed between the base and the fixing unit, with a small clearance maintained between the two components. When the user presses on a lotion bottle, the base will produce melodious music.

To enable your better understanding of the construction of the invention, the following drawings are described in details.

BRIEF DESCRIPTION OF NUMERALS

Figure 1:
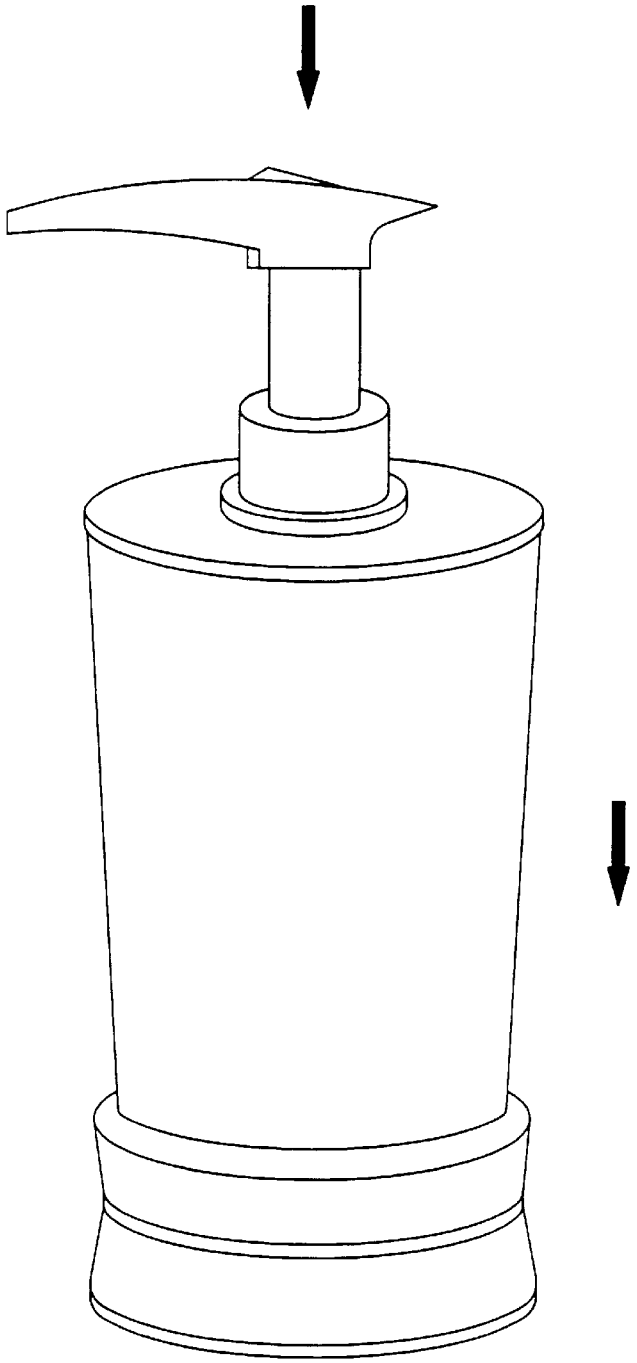
FIG. 1 is a perspective view of the invention in use.

1 base
11 circuit accommodating groove
2 silicone rubber washer
3 IC circuit set
31 IC flexible switch
4 fixing unit
41 bottle fixing groove
42 base covering groove
5 lotion bottle
51 press switch

DETAILED DESCRIPTION OF PREFERRED EMBODIMENT

Figure 2:
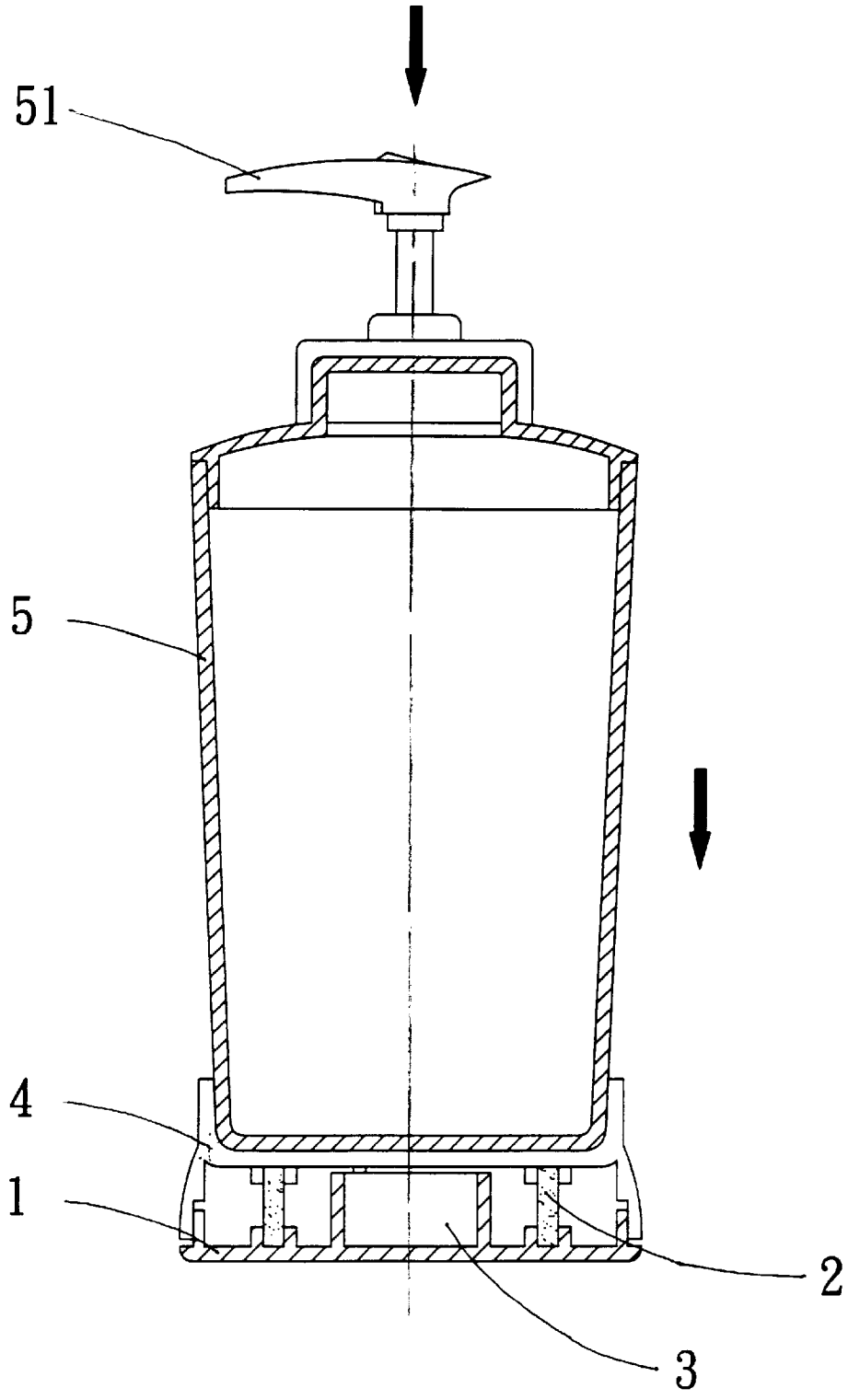
FIG. 2 is a section view of the invention.
Figure 3:
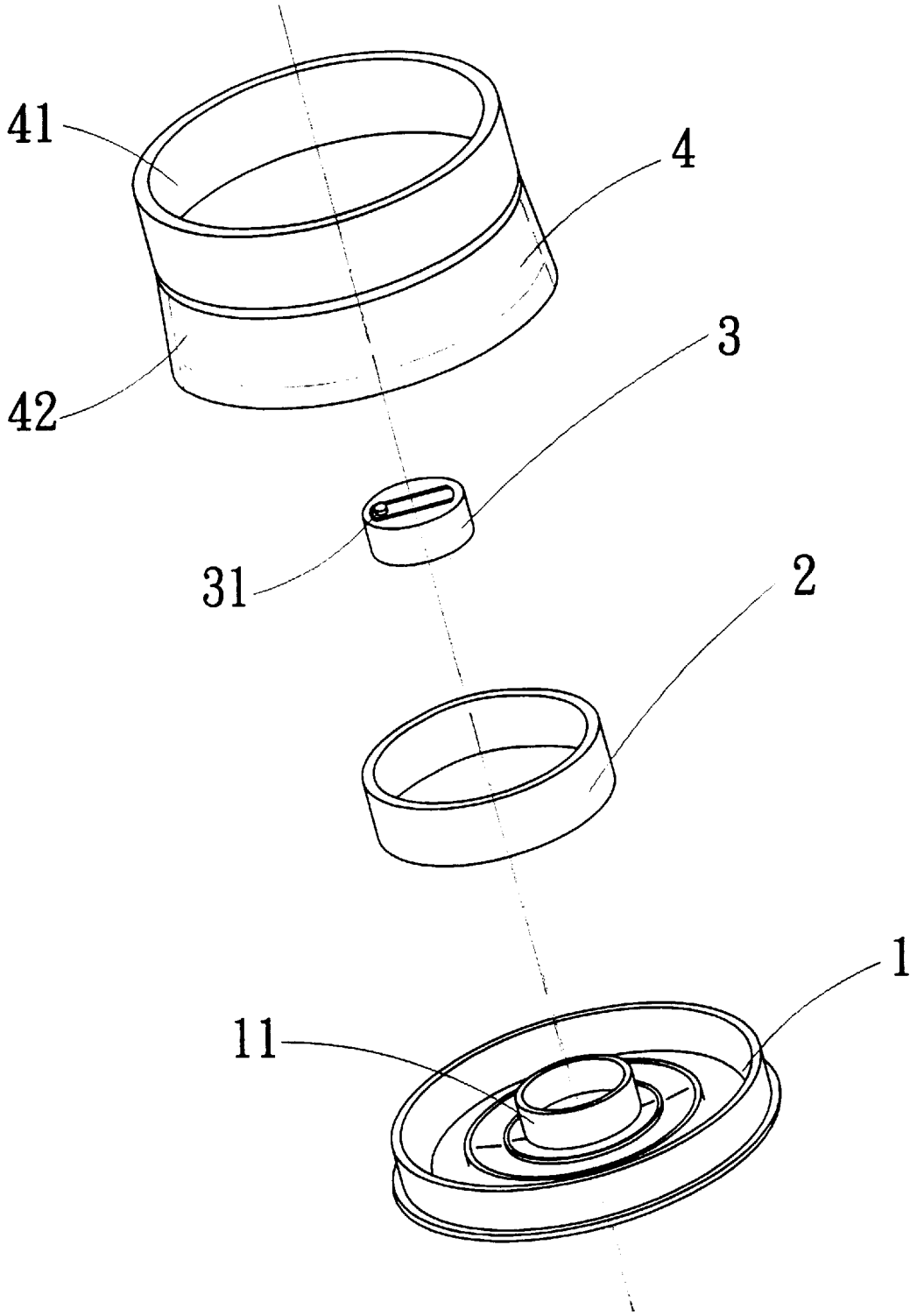
FIG. 3 is an exploded view of the invention.

As illustrated in FIGS. 1, 2 and 3, the subject invention comprises of a base (1), an IC circuit set (3), a silicone rubber washer (2) and a fixing unit (4). The base (1) and the fixing unit (4) are extrusion formed plastics. The base (1) is round, at its center is a properly sized round groove (11). The IC circuit set (3) is accommodated in the round groove (11).

On the IC circuit set is a flexible switch (31) which is protruded from the main unit of the IC circuit set (3). The silicone rubber washer (2) is flexible, having an inner diameter larger than that of the round groove (11). Before the washer (2) is installed into the base (1), an appropriate clearance is maintained between the inside wall of the pad (2) and the outside wall of the round groove (11). The upper and lower parts of the fixing unit (4) are respectively large round depressions, which are divided by a thin plate of a proper thickness, forming a bottle accommodating groove (41) on top and a base covering groove (42) on bottom. The lower part, or the base covering groove (42) is designed to cover the entire base (1), including the round groove (11), the IC circuit set (3), the IC flexible switch (31) and the silicone rubber washer (2) accommodated into the base (1).

Please refer to FIGS. 1 and 2, which illustrate how the subject invention is put to use: A lotion bottle (5) is accommodated inside the bottle accommodating groove (41) on the top of the fixing unit (4). When the user presses on the press switch (51) of the lotion bottle (5), it will not overturn because the area of the base of the bottle is too small. When the switch is depressed, the fixing unit (4) will also be depressed by the force applied. Because of the flexibility of the silicone rubber washer (2) installed between the fixing unit (4) and the base (1), the base (1) will touch the IC flexible switch (31), switching on the IC circuit set (3) to produce music. The subject invention will not only properly secure a daily-use bottle and protect it from overturning or breakage. According to the manufacturer's point of view, it is designed to stimulate the consumer's desire to purchase the product, with the IC circuit set serving as the stimulus.

It is declared herewith that the above description covering merely a preferred embodiment of the subject invention should not be based to restrict and/or limit the range of applications of the subject invention, and that all equivalent variations or modifications deriving from the above description shall be included in the intent and spirit of the subject claims.

As proved in the above description that the subject invention is doubtless an applicable, inventive novelty, which has fully met the qualifications for a patent right, hence this application is duly filed. Your favorable consideration will be appreciated.

What is claimed is:

1. A lotion bottle fixing unit, comprising the following:

a base, in the shape of a round plate, with a round depressed groove of a proper size at its center;

an IC circuit set, composed of an IC circuit board, an IC flexible switch and a casing;

a silicone rubber washer, flexible and with a proper inner diameter; and a fixing unit, with an upper round depression and a lower round depression that are divided by a thin round plate of a proper thickness to separate the upper and lower depressed grooves;

at the center of said base being a proper sized round groove, the IC circuit set being accommodated in the round groove at the center of the base, the IC flexible switch being protruded upwards from the main unit of the IC circuit set, the silicone rubber washer being flexible and having an inside diameter larger than that of the round groove; before the washer is installed in the base, a proper clearance is to be maintained between the inside wall of the washer and the outside wall of the round groove; the entire base is to be covered by the covering groove at the lower part of the fixing unit, meanwhile, it will cover the round groove on the base, the IC circuit set, the IC flexible switch and the silicone rubber washer.

2. The fixing base as recited in claim 1, which shape can also be polygonal.

3. The fixing base as recited in claim 1, to the bottom of the base can be attached a non-skid pad.

4. The fixing base as recited in claim 1, which silicone rubber washer can be replaced by a spring.

* * * * *